US009657428B2

(12) United States Patent
Jeong et al.

(10) Patent No.: US 9,657,428 B2
(45) Date of Patent: May 23, 2017

(54) DRAIN PUMP AND WASHING MACHINE HAVING THE SAME

(71) Applicant: SAMSUNG ELECTRONICS CO., LTD., Suwon-si, Gyeonggi-do (KR)

(72) Inventors: Wun Seok Jeong, Suwon-si (KR); Min Ho Jung, Suwon-si (KR); Sam Young Jang, Yongin-si (KR); Seung Mok Lee, Suwon-si (KR); Kwang Duk Baek, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 549 days.

(21) Appl. No.: 14/190,766

(22) Filed: Feb. 26, 2014

(65) Prior Publication Data

US 2014/0238089 A1 Aug. 28, 2014

(30) Foreign Application Priority Data

Feb. 27, 2013 (KR) ..... 10-2013-0021577

(51) Int. Cl.

| | |
|---|---|
| ***D06F 39/08*** | (2006.01) |
| ***D06F 39/10*** | (2006.01) |
| ***F04D 29/62*** | (2006.01) |
| ***F04D 29/70*** | (2006.01) |

(52) U.S. Cl.

CPC ..... *D06F 39/10* (2013.01); *D06F 39/085* (2013.01); *F04D 29/628* (2013.01); *F04D 29/708* (2013.01); *F05B 2260/303* (2013.01)

(58) Field of Classification Search

CPC ..... D06F 39/085; D06F 39/10; F04D 29/628; F04D 29/708; F05B 2260/303

USPC ..... 68/18 F, 208

See application file for complete search history.

(56) References Cited

U.S. PATENT DOCUMENTS

2011/0100071 A1* 5/2011 Mazzon ..... D06F 9/10 68/208

FOREIGN PATENT DOCUMENTS

| | | |
|---|---|---|
| DE | 3538174 | 4/1987 |
| DE | 4444784 | 6/1995 |
| EP | 2316999 | 5/2011 |

(Continued)

OTHER PUBLICATIONS

Extended European Search Report dated Jul. 7, 2014 in corresponding European Patent Application No. 14156376.7.

(Continued)

*Primary Examiner* — Michael Barr
*Assistant Examiner* — Levon J Shahinian
(74) *Attorney, Agent, or Firm* — Staas & Halsey LLP

(57) ABSTRACT

A washing machine includes: a cabinet; a tub; a pump case provided so as to drain washing water; a pump filter that filters foreign substances in washing water and is able to be detached from the pump case; and a pump filter head that is combined with one side of the pump filter and causes the pump filter to rotate, wherein the pump filter head includes: a first head having a first state in which the first head is engaged with one side of the pump case and is combined with the pump case and a second state in which the first head is released from the pump case; and a second head that is positioned at front of the first head and is rotatable separately from the first head in the first state. A user can recognize whether the pump filter is fully fastened to the pump case.

23 Claims, 11 Drawing Sheets

(56) References Cited

FOREIGN PATENT DOCUMENTS

KR 10-2006-0004130 1/2006

OTHER PUBLICATIONS

European Decision on Grant dated Jun. 13, 2016 in corresponding European Patent Application No. 14 156 376.7.

* cited by examiner

DRAIN PUMP AND WASHING MACHINE HAVING THE SAME

CROSS-REFERENCE TO RELATED APPLICATIONS

This application claims the benefit of Korean Patent Application No. 10-2013-0021577, filed on Feb. 27, 2013 in the Korean Intellectual Property Office, the disclosure of which is incorporated herein by reference.

BACKGROUND

1. Field

Embodiments of the present disclosure relate to a drain pump and a washing machine having the same, and more particularly, to a drain pump having an improved structure in which a pump filter is detached from the drain pump, and a washing machine having the same.

2. Description of the Related Art

Washing machines are machines that wash clothes using electricity. Washing machines each include a tub in which washing water is stored, a rotating tub that is rotatably installed in the tub, a driving device for driving the rotating tub by rotation, a water supply device for supplying washing water to the tub, and a drain pump for forcibly discharging washing water in the tub.

The drain pump includes a pump case having a washing water inflow chamber in which washing water is accommodated and a drain pump chamber, and a pumping motor installed at one side of the pump case. A pump filter is installed in the pump case so as to filter foreign substances contained in washing water, and an impeller that is rotated and driven by the pumping motor is installed in the drain pump chamber.

If the impeller is rotated by the pumping motor, washing water in the tub flows in the washing water inflow chamber, washing water flowing in the washing water inflow chamber passes through the pump filter and then is absorbed into the drain pump chamber, and washing water that reaches the drain pump chamber is forcibly discharged to an outer side of the drain pump by the impeller.

When washing water passes through the pump filter, foreign substances contained in washing water are filtered by the pump filter. Subsequently, a user may take out the pump filter from the pump case so as to remove the foreign substances and may insert the pump filter into the pump case. However, when the pump filter is inserted into the pump case and is not fully fastened to the pump case, the user cannot recognize the state in which the pump filter is inserted into the pump case and is not fully fastened to the pump case, and thus water leaks.

SUMMARY

Therefore, it is an aspect of the present disclosure to provide a washing machine having an improved detachment structure of a pump filter so that a user can recognize whether the pump filter is inserted into the washing machine.

Additional aspects will be set forth in part in the description which follows and, in part, will be obvious from the description, or may be learned by practice of the invention.

In accordance with one aspect, a washing machine includes: a cabinet; a tub disposed in the cabinet so as to accommodate washing water in the tub; a pump case in which a washing water inflow chamber and a drain pump chamber are provided, so as to drain washing water in the tub; a pump filter that filters foreign substances in washing water flowing from the tub and is able to be detached from the pump case; and a pump filter head that is combined with one side of the pump filter and causes the pump filter to rotate in at least one of a clockwise direction and a counterclockwise direction, wherein the pump filter head includes: a first head having a first state in which the first head is engaged with one side of the pump case and is combined with the pump case and a second state in which the first head is released from the pump case; and a second head that is positioned at front of the first head and is rotatable separately from the first head in the first state.

The first head may include at least one first head protrusion part provided at an inner side of the first head so as to protrude from a direction of the second head, and the second head may include at least one second head protrusion part provided at an inner side of the second head so as to protrude from a direction of the first head.

The first head and the second head may be combined with each other so as to be spaced apart from each other by a predetermined distance.

The washing machine may further include an elastic member that is positioned between the first head and the second head so as to prevent a noise and shock caused by contact between the first head and the second head.

At least three second head protrusion parts may be provided.

A distance between the first head protrusion part and the first head protrusion part may be uniform.

At least one of the first head protrusion part and the second head protrusion part may include an inclination part having one inclined surface.

The first head inclination part and the second head inclination part may be disposed to contact each other when the second head is rotated in one of the clockwise direction and the counterclockwise direction.

The second head may further include a slit provided close to the second head protrusion part so that the second head protrusion part has flexibility with respect to the second head.

A hanging jaw may be provided at at least a part of the first head so as to prevent the first head from being rotated with respect to the pump case.

A graspable handle part may be combined with an outer side of the second head.

The washing machine may further include a sealing member that is combined with a rear side of the pump filter head so as to absorb friction between the pump filter and the pump case and to prevent water leak.

The pump filter may include a pump case inclination surface in which at least a part of the pump case contacting the pump filter is inclined, when the pump filter is inserted into the pump case.

The sealing member may include a concave part in which at least a part of a thickness surface of the sealing member is concave, so as to reduce force required when the pump filter is detached from the pump case.

In accordance with one aspect, a washing machine includes: a cabinet; a tub; and a drain pump that pumps washing water in the tub, wherein the drain pump includes: a pump case in which a washing water inflow chamber and a drain pump chamber are provided; and a pump filter that filters foreign substances in washing water flowing from the tub, rotates in at least one of a clockwise direction and a counterclockwise direction with respect to the pump case, and is able to be detached from the pump case, and wherein the pump filter includes: a pump filter body inserted into the pump case; and a pump filter head that is combined with front of the pump filter body and generates a sound so that a user is able to recognize whether the pump filter body is normally combined with the pump case.

The pump filter head may include a first head combined with the pump case and a second head positioned at front of the first head, and the second head may be rotatable separately from the first head in a state in which the first head is combined with the pump case.

A sound may be generated in the pump filter head due to separate rotation of the second head.

When the second head is rotated with respect to the first head in the state in which the first head is combined with the pump case, the first head may include at least one first head protrusion part provided at an inner side of the first head so as to protrude from a direction of the second head so that a user is able to recognize an auditory or tactile change, and the second head may include at least one second head protrusion part provided at an inner side of the second head so as to protrude from a direction of the first head.

The washing machine may further include an elastic member that is positioned between the first head and the second head so that a predetermined distance between the first head and the second head is able to be maintained when the first head is combined with the pump case.

At least one hanging jaw through which the pump filter head is combined with the pump case, may be provided at at least a part of the first head, and a contact part may be provided at at least a part of the pump case so as to contact the hanging jaw.

The washing machine may further include a sealing member that is combined between the pump filter head and the pump case so as to absorb friction between the pump filter and the pump case and to prevent water leak.

In accordance with one aspect, a drain pump includes: a pump case in which washing water is accommodated; and a pump filter that filters foreign substances in the pump case and includes a body and a head so as to be able to be detached from the pump case, wherein the pump filter head includes: a first head that is combined with the pump case; and a second head that is combined with front of the first head and is additionally rotatable after the first head is combined with the pump case.

The first head may include a hanging jaw through which the pump filter head is combined with the pump case, and the pump case may include a contact part through which the pump case is combined with the first head.

The first head may include at least one first head protrusion part provided at an inner side of the first head so as to protrude from a direction of the second head, and the second head may include at least one second head protrusion part provided at an inner side of the second head so as to protrude from a direction of the first head.

The drain pump may further include an elastic member that is positioned between the first head and the second head so as to maintain a balance between the first head and the second head.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
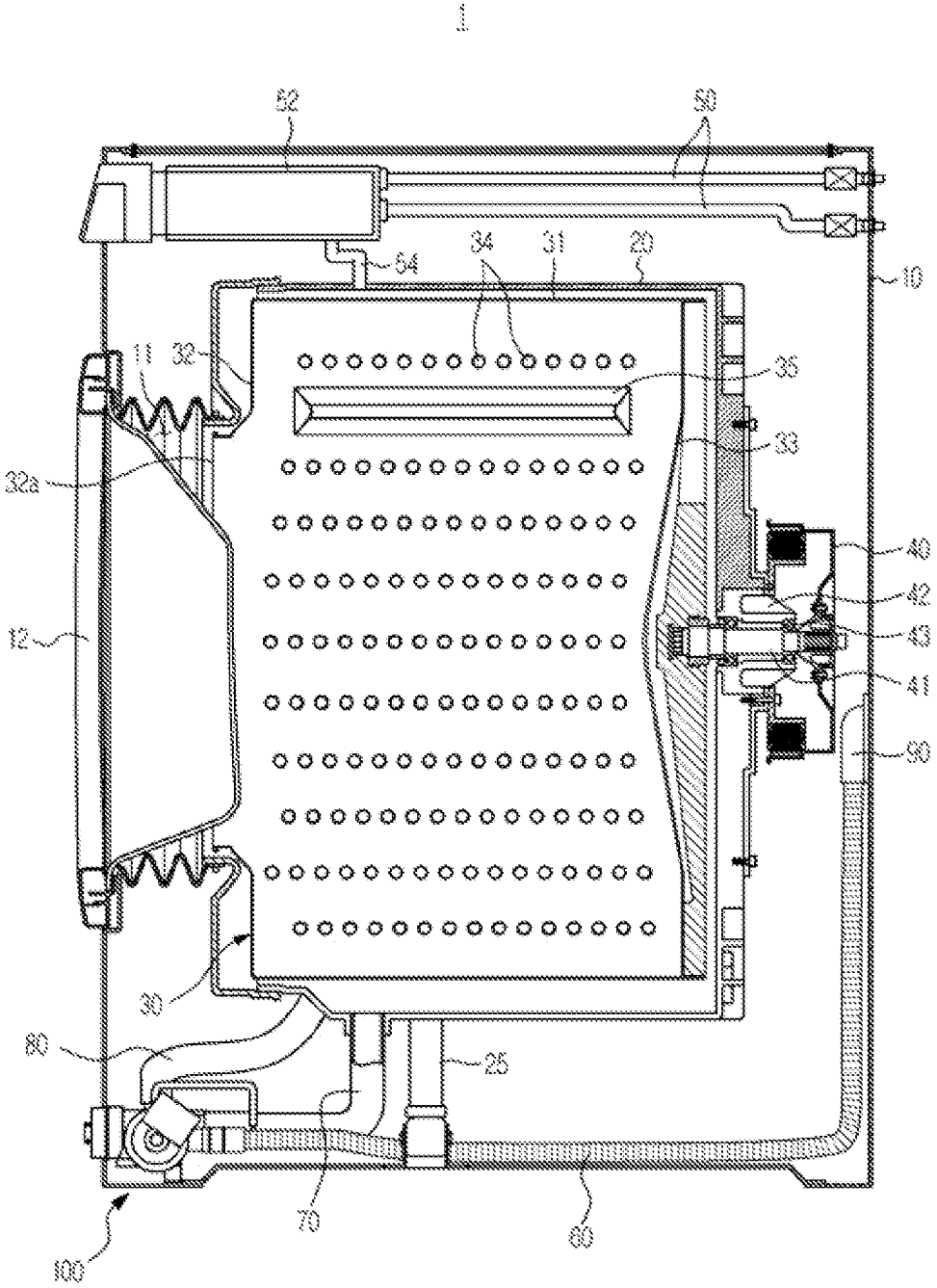
FIG. 1 is a cross-sectional view illustrating a configuration of a washing machine according to an embodiment.

Reference will now be made in detail to the embodiments, examples of which are illustrated in the accompanying drawings, wherein like reference numerals refer to like elements throughout.

Figure 2:
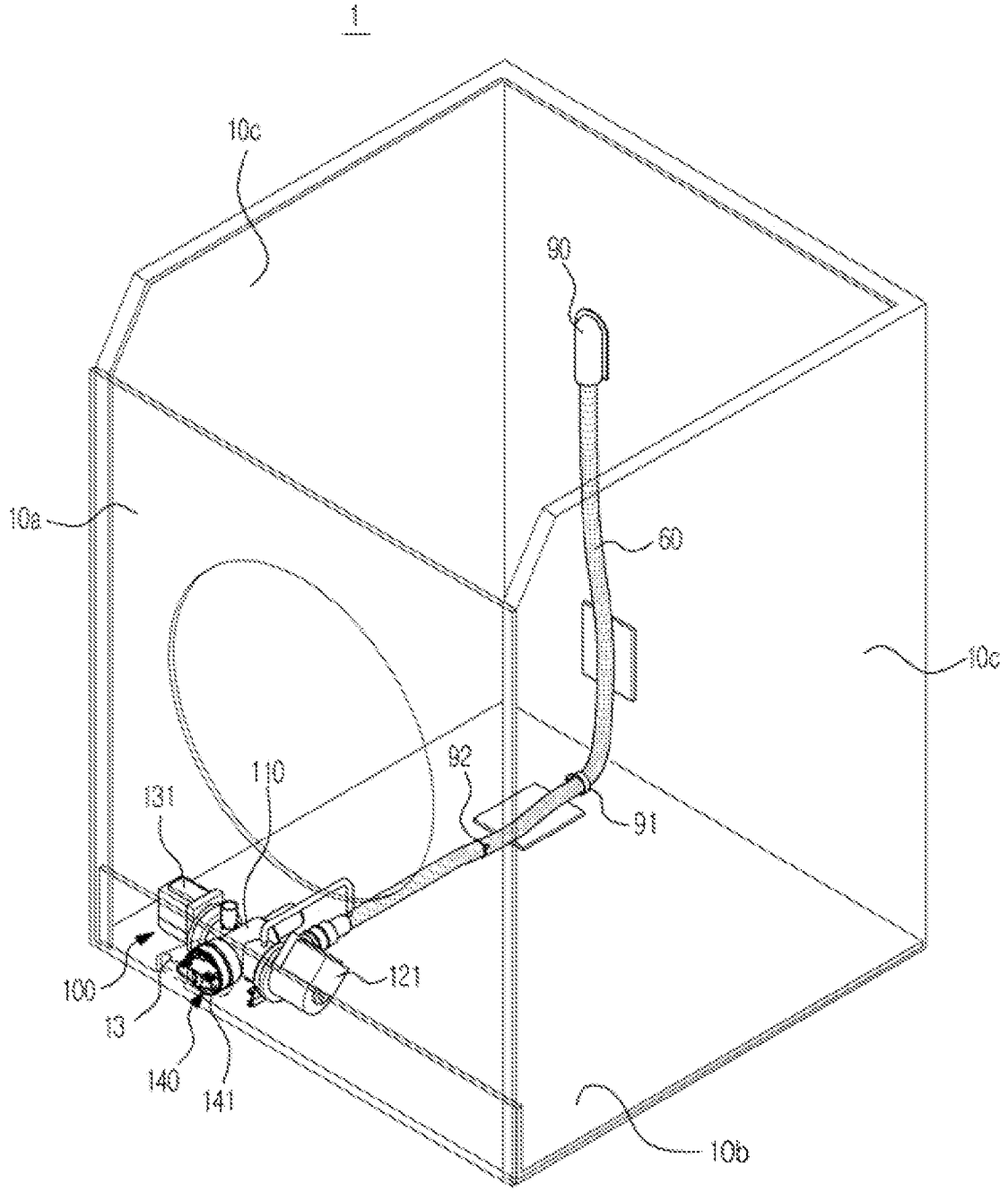
FIG. 2 is a perspective view illustrating a drain pump and a drain hose of the washing machine illustrated in FIG. 1.

FIG. 1 is a cross-sectional view illustrating a configuration of a washing machine according to an embodiment, and FIG. 2 is a perspective view illustrating a drain pump and a drain hose of the washing machine illustrated in FIG. 1.

As illustrated in FIGS. 1 and 2, a washing machine 1 includes a cabinet 10 that constitutes the exterior of the washing machine 1, a tub 20 disposed in the cabinet 10, a rotating tub 30 rotatably disposed in the tub 20, and a motor 40 that drives the rotating tub 30.

The cabinet 10 includes a plurality of frames 10*a*, 10*b*, and 10*c*. The plurality of frames 10*a*, 10*b*, and 10*c* include a front frame 10*a* that constitutes a front side of the cabinet 10, side frames 10*c* that constitute sides and a rear side of the cabinet 10, and a bottom frame 10*b* that constitutes a bottom side of the cabinet 10.

A portion that is upwardly bent and is combined with the front frame 10*a* may be formed at a front side of the bottom frame 10*b*.

A laundry port 11 through which laundry may be put into the rotating tub 30, is formed at the front side of the cabinet 10. The laundry port 11 is opened and closed by a door 12 installed at the front side of the cabinet 10.

The tub 20 is supported by a damper 25. The damper 25 connects an inner bottom side of the cabinet 10 and an outer side of the tub 20.

A water supply pipe 50 is installed at an upper portion of the tub 20 so as to supply washing water to the tub 20. One side of the water supply pipe 50 is connected to an external water supply source (not shown), and the other side of the water supply pipe 50 is connected to a detergent supply device 52.

The detergent supply device 52 is connected to the tub 20 via a connection pipe 54. Water supplied via the water supply pipe 50 is supplied into the tub 20 together with detergent via the detergent supply device 52.

The rotating tub 30 includes a cylindrical part 31, a front panel 32 disposed on the front of the cylindrical part 31, and a rear panel 33 disposed on the rear of the cylindrical part 31. An opening 32*a* through which laundry is put into the rotating tub 30, is formed in the front panel 32, and a driving shaft 41 is connected to the rear panel 33 so as to transfer power of the motor 40.

A plurality of through holes 34 through which washing water flows in or out, are formed in a circumference of the rotating tub 30 such that an internal space of the rotating tub 30 and an internal space of the tub 20 communicate with each other.

A plurality of lifters 35 are installed at an inner circumferential surface of the rotating tub 30 so that laundry can ascend or descend when the rotating tub 30 rotates.

The driving shaft 41 is disposed between the rotating tub 30 and the motor 40. One end of the driving shaft 41 is connected to the rear panel 33 of the rotating tub 30, and the other end of the driving shaft 41 extends to an outer side of a rear wall of the tub 20. When the motor 40 drives the driving shaft 41, the rotating tub 30 connected to the driving shaft 41 rotates around the driving shaft 41.

A bearing housing 42 is installed at the rear wall of the tub 20 so as to rotatably support the driving shaft 41. The bearing housing 42 may be formed of an aluminum alloy and may be inserted into the rear wall of the tub 20 when the tub 20 is injection molded. A plurality of bearings 43 are installed between the bearing housing 42 and the driving shaft 41 so that the driving shaft 41 can be smoothly rotated.

When a washing operation is performed, the motor 40 causes the rotating tub 30 to rotate in a forward/backward direction at a low speed. Thus, contaminant is removed from laundry while laundry inside the rotating tub 30 ascends or descends repeatedly.

When a dehydration operation is performed, if the motor 40 causes the rotating tub 30 to rotate in one direction at a high speed, water is separated from laundry due to a centrifugal force exerted on laundry.

A drain pump 100 is installed at an inner lower portion of the cabinet 10 so as to pump washing water stored in the tub 20. Washing water that passes through the drain pump 100 is discharged to an outer side of the washing machine 1 via a drain hose 60.

The drain pump 100 is exposed to the front side of the cabinet 10 via a through hole formed in a portion where a protrusion part of the bottom frame 10*b* and a bottom end of the front frame 10*a* overlap each other.

The drain hose 60 is combined with an inner side of the cabinet 10 via a hose wire 92 and hose holders 91 not to interfere with other components inside the cabinet 10 and is guided to an outer side of the cabinet 10 via a hose guide 90.

Figure 3:
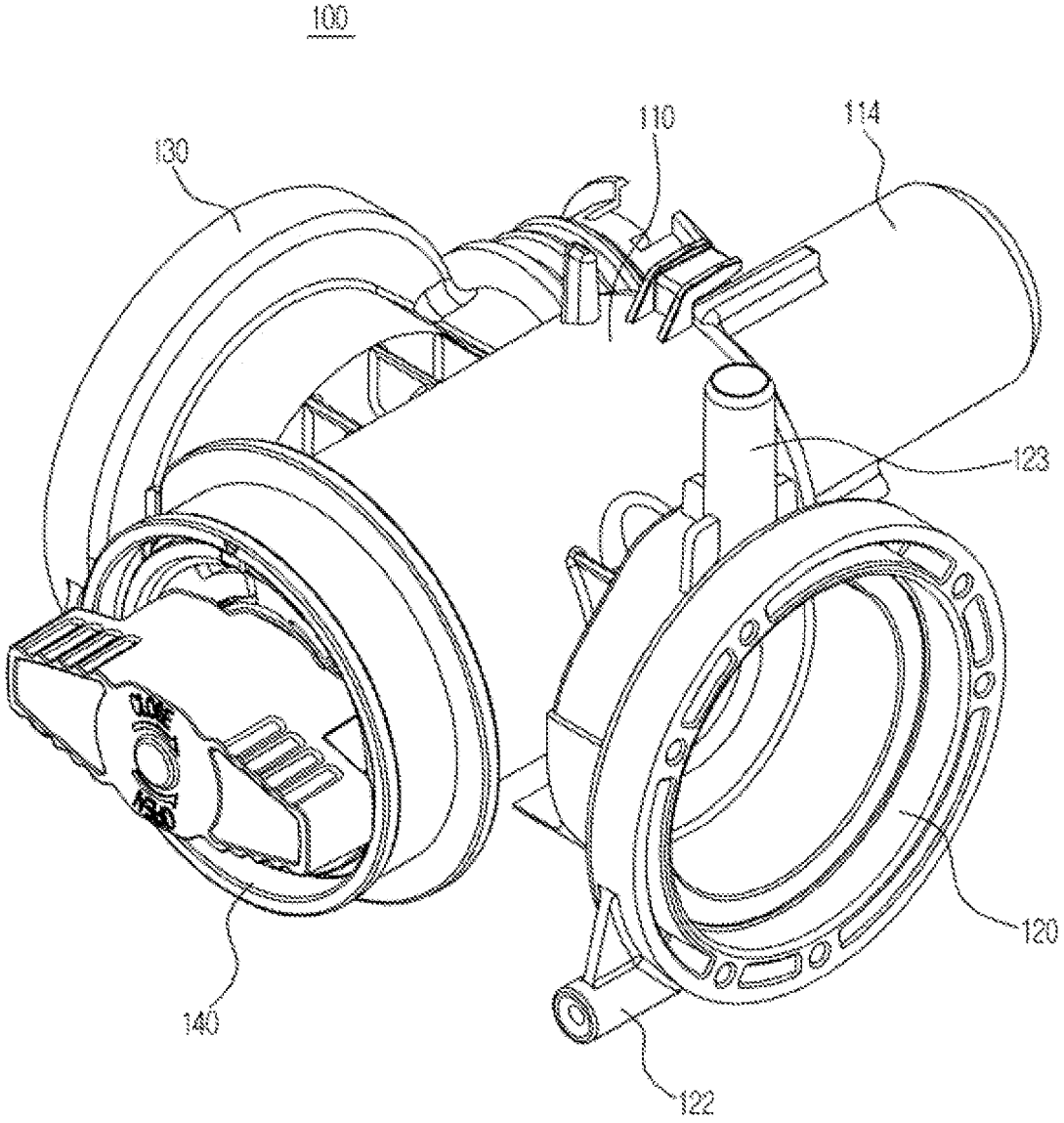
FIG. 3 is an enlarged view illustrating a drain pump according to an embodiment.
Figure 4:
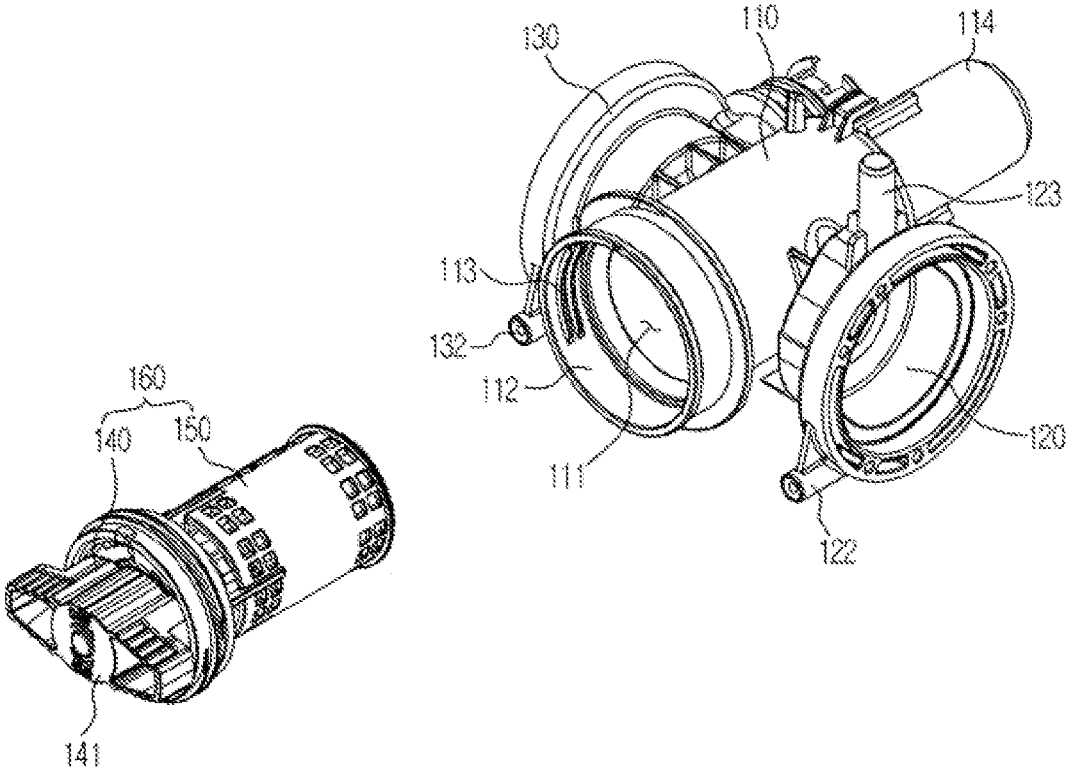
FIG. 4 is a view illustrating a state in which a pump filter is disassembled from the drain pump illustrated in FIG. 3.
Figure 5:
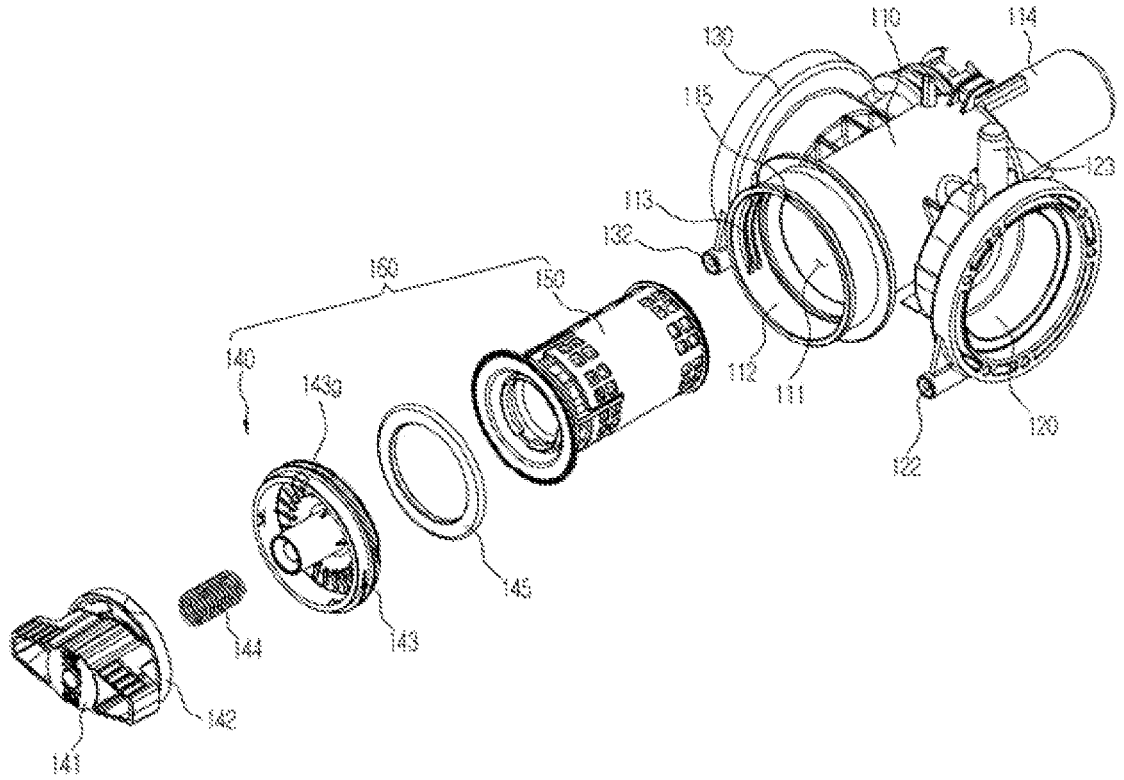
FIG. 5 is an exploded view illustrating the drain pump of FIG. 3.

FIG. 3 is an enlarged view illustrating a drain pump according to an embodiment on, FIG. 4 is a view illustrating a state in which a pump filter is disassembled from the drain pump illustrated in FIG. 3, and FIG. 5 is an exploded view illustrating the drain pump of FIG. 3.

As illustrated in FIGS. 3 through 5, the drain pump 100 includes a pump case 110 having a washing water inflow chamber 111, a drain pump chamber 130, and a circulation chamber 120, and a pump filter 160 inserted in the washing water inflow chamber 111. The drain pump chamber 130 and the circulation chamber 120 are disposed to face each other in a state in which the washing water inflow chamber 111 is interposed between the drain pump chamber 130 and the circulation chamber 120.

A circulation pump (see 121 of FIG. 2) is disposed at one side of the circulation chamber 120 of the pump case 110, and a circulation impeller (not shown) is connected to the circulation pump 121. The circulation impeller (not shown) is disposed within the circulation chamber 120.

A circulation port 123 is formed on a top end of the circulation chamber 120 and extends in an upward direction of the circulation chamber 120 so as to circulate washing water into the tub 20, and a circulation pipe (see 80 of FIG. 1) is connected to the circulation port 123.

When the circulation impeller (not shown) rotates due to the circulation pump 121, the circulation impeller absorbs washing water in the washing water inflow chamber 111 in an axial direction. Bubbles may be generated in the circulation chamber 120 in addition to a function of circulating washing water in the circulation chamber 120. In this case, air and washing water are mixed with each other in the circulation chamber 120 using a pressure difference caused by pressure drop generated by movement of washing water such that the bubbles can be generated in the circulation chamber 120. The bubbles flow into the tub 20 via the circulation port 123 and the circulation pipe 80 due to the circulation impeller (not shown).

A pump filter head 140 and a pump filter body 150 are mounted on the front side of the washing water inflow chamber 111 and remove foreign substances contained in washing water that flows from the tub 20.

The pump filter 160 has a cylindrical shape in which a hollow is formed and includes the pump filter head 140 and the pump filter body 150. When the pump filter 160 is mounted on the pump case 110, the pump filter body 150 of the pump filter 160 is accommodated in the washing water inflow chamber 111 of the pump case 110. The hollow is formed in an inner wall of the pump filter body 150. No hollow is formed in the inner wall of the pump filter body 150 that communicates with the circulation chamber 120 so as to filter the foreign substances contained in washing water, and a hollow may be formed in the inner wall of the pump filter body 150 that communicates with the drain pump chamber 130. Thus, the foreign substances contained in washing water do not move to the circulation chamber 120 but is positioned in a direction of the drain pump chamber 130.

The pump filter head 140 may include a first head 143 and a second head 142. The first head 143 may be combined with the pump case 110, and the second head 142 may be combined with the front of the first head 143. An elastic member 144 may be positioned between the first head 143 and the second head 142. This will be described later.

A first screw thread 143*g* through which the pump filter 160 is combined with the pump case 110, may be formed at a side of the first head 143. A handle part 141 may be combined with a front side of the second head 142 so that the user may grasp the handle part 141 to rotate the pump filter head 140.

Also, a sealing member 145 may be combined between the first head 143 and the pump filter body 150. The sealing member 145 is combined so as to absorb friction between the pump filter 160 and the pump case 110 and to prevent water leak. The sealing member 145 may be formed of a flexible material, for example, urethane.

An entrance part 112 through which the pump filter 160 can be inserted into the pump case 110, is formed at the front of the washing water inflow chamber 111, and a second screw thread 113 having a shape corresponding to the first screw thread 143*g* of the pump filter 160 is formed at an edge of the entrance part 112.

Referring to FIG. 2, the pump filter head 140 of the pump filter 160 is exposed to the front side of the cabinet 10 through the through hole that passes through the bottom frame 10*b* and the front frame 10*a*. A cover (not shown) that covers the through hole is combined with the front frame 10*a*.

The user may open the cover (not shown), may grasp the handle part 141 of the exposed pump filter head 140 of the pump filter 160, may rotate the pump filter head 140, may detach the pump filter 160 from the drain pump 100, and then may replace or clean the pump filter 160. The pump filter 160 may be rotated in at least one of a clockwise direction and a counterclockwise direction with respect to the pump case 110 and may be detached from the drain pump 100.

Fastening holes 122 and 132 through which the pump case 110 is combined with the protrusion part of the bottom frame 10*b*, are formed in outer lower ends of the circulation chamber 120 and the drain pump chamber 130 of the pump case 110. When a fastening member (not shown) is fastened to the fastening holes 122 and 123 through the protrusion part of the bottom frame 10*b*, the protrusion part of the bottom frame 10*b* and the pump case 110 are combined with each other.

The drain hose 60 is connected to the drain pump chamber 130, and the drain hose 60 guides washing water pumped by the circulation impeller (not shown) to the outer side of the cabinet 10 and causes washing water to be drained.

Figure 6:
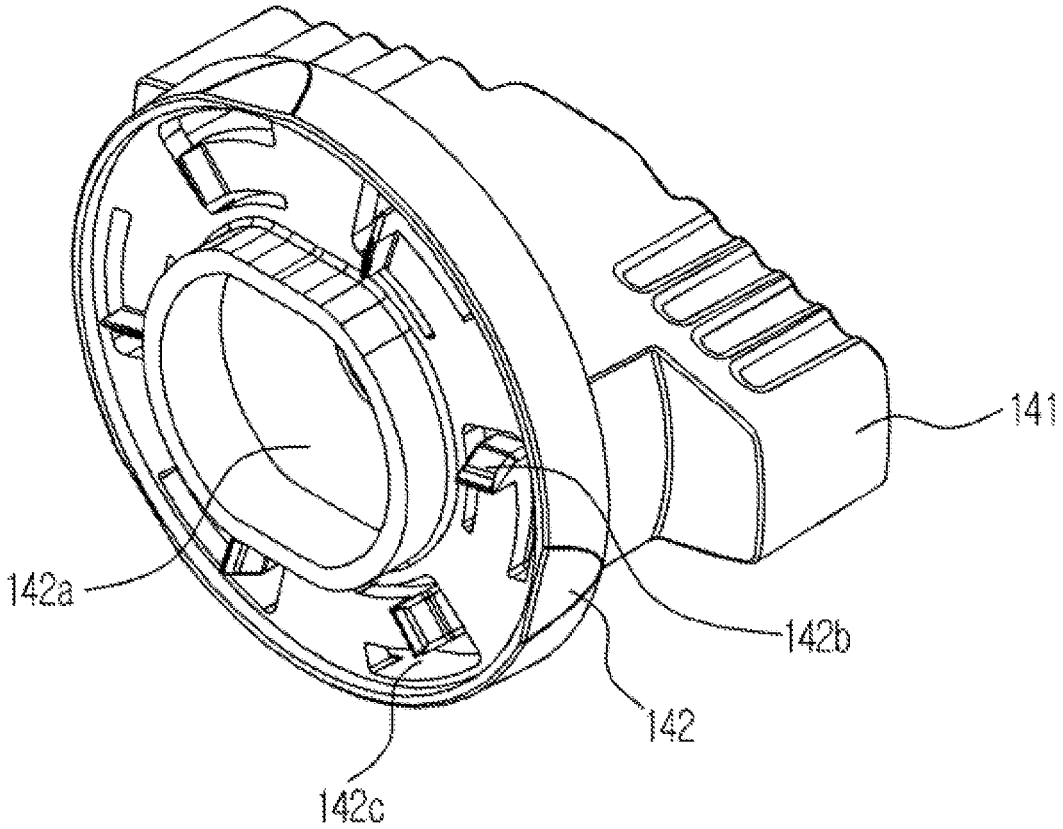
FIG. 6 is a view illustrating a second head of the pump filter of the drain pump of FIG. 3.
Figure 7:
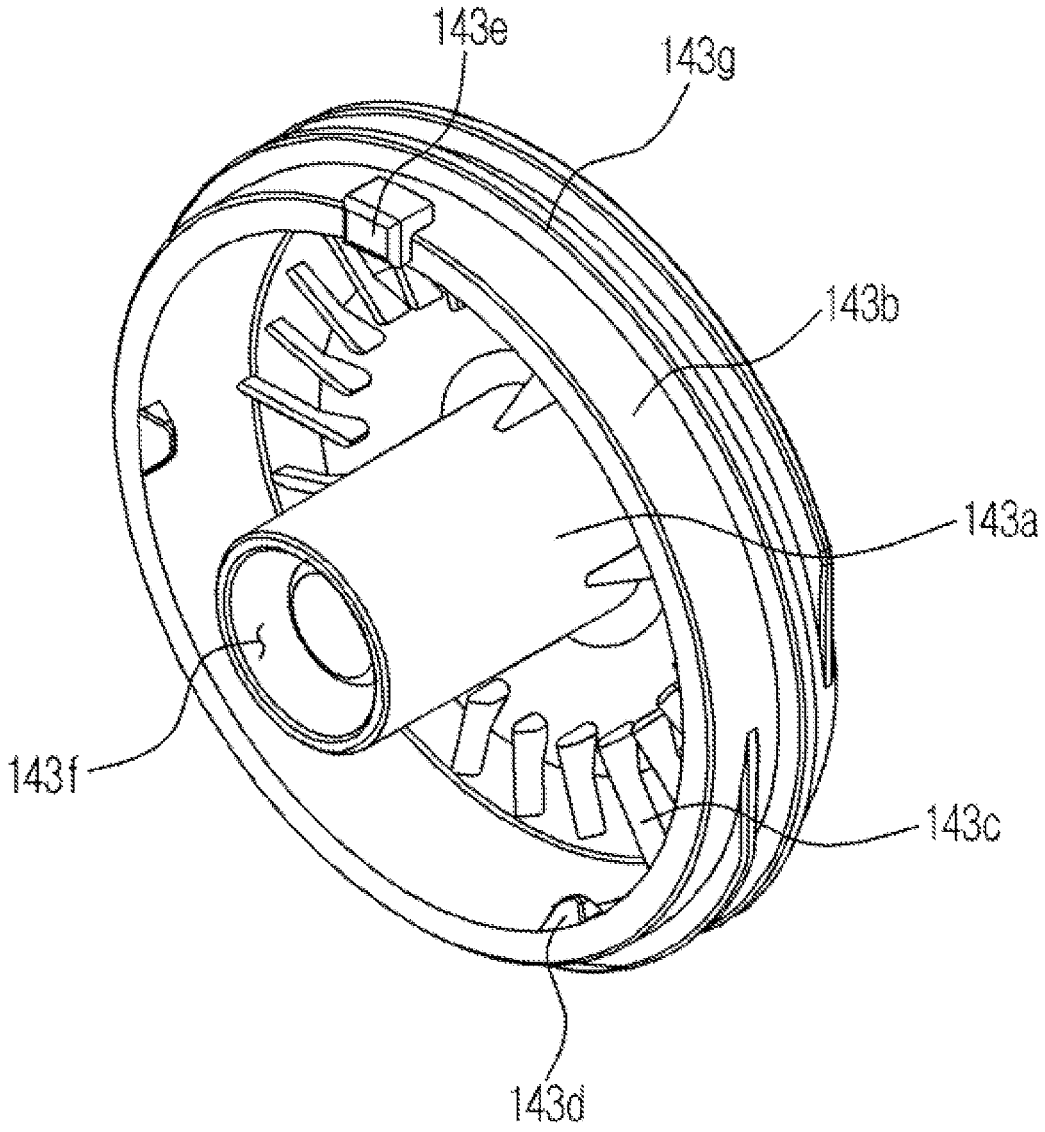
FIG. 7 is a view illustrating a first head of the pump filter of the drain pump of FIG. 3.
Figure 8:
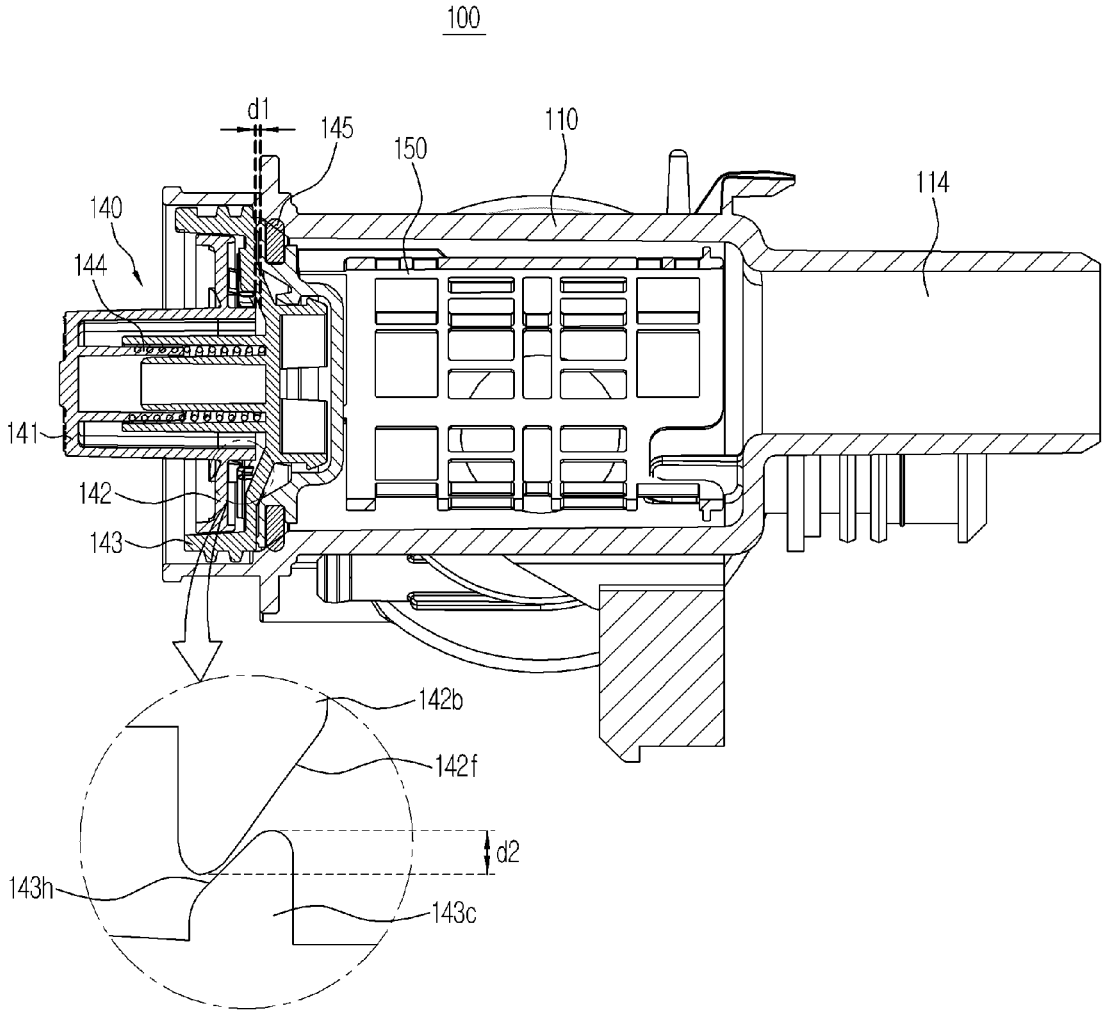
FIG. 8 is a cross-sectional view illustrating the pump filter of the drain pump of FIG. 3.

FIG. 6 is a view illustrating a second head of the pump filter of the drain pump of FIG. 3, FIG. 7 is a view illustrating a first head of the pump filter of the drain pump of FIG. 3, and FIG. 8 is a cross-sectional view illustrating the pump filter of the drain pump of FIG. 3.

As illustrated in FIGS. 6 through 8, the pump filter head 140 includes the first head 143 and the second head 142. The first head 143 may be combined with the pump case 110. A state in which the first head 143 is engaged with one side of the pump case 110 and is combined with the pump case 110, is defined as a first state, and a state in which the first head 143 is released from the one side of the pump case 110, is defined as a second state. The second head 142 may be combined with an outer side of the first head 143 and may be rotated separately from the first head 143 in the first state. That is, when the first head 143 is combined with the pump case 110, the second head 142 may be rotated with respect to the first head 143.

At least one first head protrusion part 143*c* may be provided at an inner side of the first head 143 so as to protrude from a direction of the second head 142, and at least one second head protrusion part 142*b* may be provided at an inner side of the second head 142 so as to protrude from a direction of the first head 143. Through the first head protrusion part 143*c* and the second head protrusion part 142*b*, the user may emotionally recognize that the second head 142 is rotated with respect to the first head 143, using auditory and tactile senses when the second head 142 is rotated with respect to the first head 143.

In the drawings, six second head protrusion parts 142*b* are shown. However, the illustrated embodiment is not limited thereto, and at least three second head protrusion parts 142*b* may be provided. When the number of second head protrusion parts 142*b* decreases, auditory and tactile effects that are generated when the second head protrusion part 142*b* contacts the first head protrusion part 143*c*, can be lowered. When the number of second head protrusion parts 142*b* increases drastically, the size of the second head 142 needs to be increased. Thus, it is appropriate that three to six second head protrusions parts 142*b* are provided.

Also, the second head 142 may include a slit 142*c* provided close to the second head protrusion part 142*b*. The slit 142*c* is provided so that the second head protrusion part 142*b* has flexibility with respect to the second head 142. Thus, even when the second head protrusion part 142*b* contacts the first head protrusion part 143*c* and the second head 142 is rotated, the second head protrusion part 142*b* may not be damaged and may be rotated. According to the drawings, the slit 142*c* is provided to surround three sides of the second head protrusion part 142*b;* however, aspects of the present invention are not limited thereto.

The first head protrusion parts 143*c* may be provided at an inner side of the first head 143 by a uniform distance. The elastic member 144 may be inserted into a first head hole 143*f* formed in an inner side of a first head boss 143*a* provided in the center of the first head 143. The elastic member 144 may be inserted into the first head hole 143*f* so as to protrude from the first head hole 143*f*. Thus, when the first head 143 and the second head 142 are combined with each other, the first head 143 and the second head 142 may be combined with each other so as to be spaced apart from each other by a predetermined distance due to the elastic member 144. Thus, the second head 142 that is positioned at an upper side than the first head 143 may be prevented from being inclined toward the first head 143. Through the elastic member 144, damage caused by a noise and contact that occur when the first head 143 and the second head 142 contact each other can be prevented. Also, according to the drawings, a coil spring is used as the elastic member 144. However, the illustrated embodiment is not limited thereto, and a ring spring, a dish-shaped spring, a leaf spring, or the like may be used as the elastic member 144.

According to an embodiment, a distance d1 between a second head hole 142*a* provided in the center of the second head 142 and a bottom surface of the first head 143 may be 0.4 mm in the first state. That is, a distance of 0.4 mm may exist between the first head 143 and the second head 142 in a state in which the first head 143 and the pump case 110 are combined with each other. Thus, the second head 142 may be rotated with flexibility with respect to the first head 143.

Also, a region in which at least a part of the first head protrusion part 143*c* and at least a part of the second head protrusion part 142*b* overlap each other, is formed in the first state. In the first state, a length d2 at which the first head protrusion part 143*c* and the second head protrusion part 142*b* overlap each other, may be 1.07 mm to 1.17 mm.

Also, a hanging jaw 143*e* through which the pump filter head 140 is combined with the pump case 110, may be provided at at least a part of the first head 143. Also, a contact part 115 may be provided at at least a part of the pump case 110 so as to contact the hanging jaw 143*e*. Also, a combination part 143*d* for combining the first head 143 and the second head 142 may be provided at an edge of the first head 143.

At least one of the first head protrusion part 143*c* and the second head protrusion part 142*b* may include inclination parts 142*f* and 143*h* each having one inclined surface. According to the drawings, the first head protrusion part 143*c* and the second head protrusion part 142*b* each include an inclination part; however, aspects of the present invention are not limited thereto. The first head inclination part 143*h* and the second head inclination part 142*f* may be disposed to contact each other when the second head 142 is rotated in one of the clockwise direction and the counterclockwise direction. Thus, when the second head 142 is rotated, the second head protrusion part 142*b* passes through the first head protrusion part 143*c*, and the second head inclination part 142*f* and the first head inclination part 143*h* contact each other. Through the inclination parts 142*f* and 143*h*, the second head protrusion part 142*b* may pass through the first head protrusion part 143*c* with small force such that the second head 142 can be smoothly rotated. Also, the second head 142 can be prevented from being rotated in a set opposite direction. According to an embodiment of the present invention, the inclination parts 142*f* and 143*h* may be provided to be inclined at 45° with respect to a horizontal plane.

When the user rotates the pump filter head 140, the first state in which the hanging jaw 143*e* of the first head 143 and the contact part 115 of the pump case 110 contact each other and the first head 143 and the pump case 110 are combined with each other, is established. Thus, the first head 143 is not rotated with respect to the pump case 110 any more. Subsequently, if the user rotates the pump filter head 140, the second head 142 is rotated with respect to the first head 143, and due to contact between the second head protrusion part 142*b* of the second head 142 and the first head protrusion part 143*c* of the first head 143, the user may recognize auditory and tactile stimuli. That is, since, in the second state in which the first head 143 and the pump case 110 are not combined with each other yet, the first head 143 and the second head 142 are rotated with respect to the pump case 110, the user cannot feel auditory and tactile stimuli. However, in the first state in which the first head 143 is combined with the pump case 110, the first head 143 is not rotated, and only the second head 142 is rotated with respect to the first head 143. Thus, the user can recognize auditory and tactile stimuli caused by contact of the first head protrusion part 143*c* and the second head protrusion part 142*b* and can recognize that the pump filter head 140 and the pump filter body 150 have been fully fastened to each other. In detail, if the pump filter 160 is combined with the pump case 110, a "rattling" noise occurs due to friction between the first head protrusion part 143*c* and the second head protrusion part 142*b* such that the user can recognize whether the pump filter 160 is combined with the pump case 110. Thus, when the pump filter 160 is not fully fastened to the pump case 110, water leak can be prevented from occurring from the drain pump 100.

Figure 9:
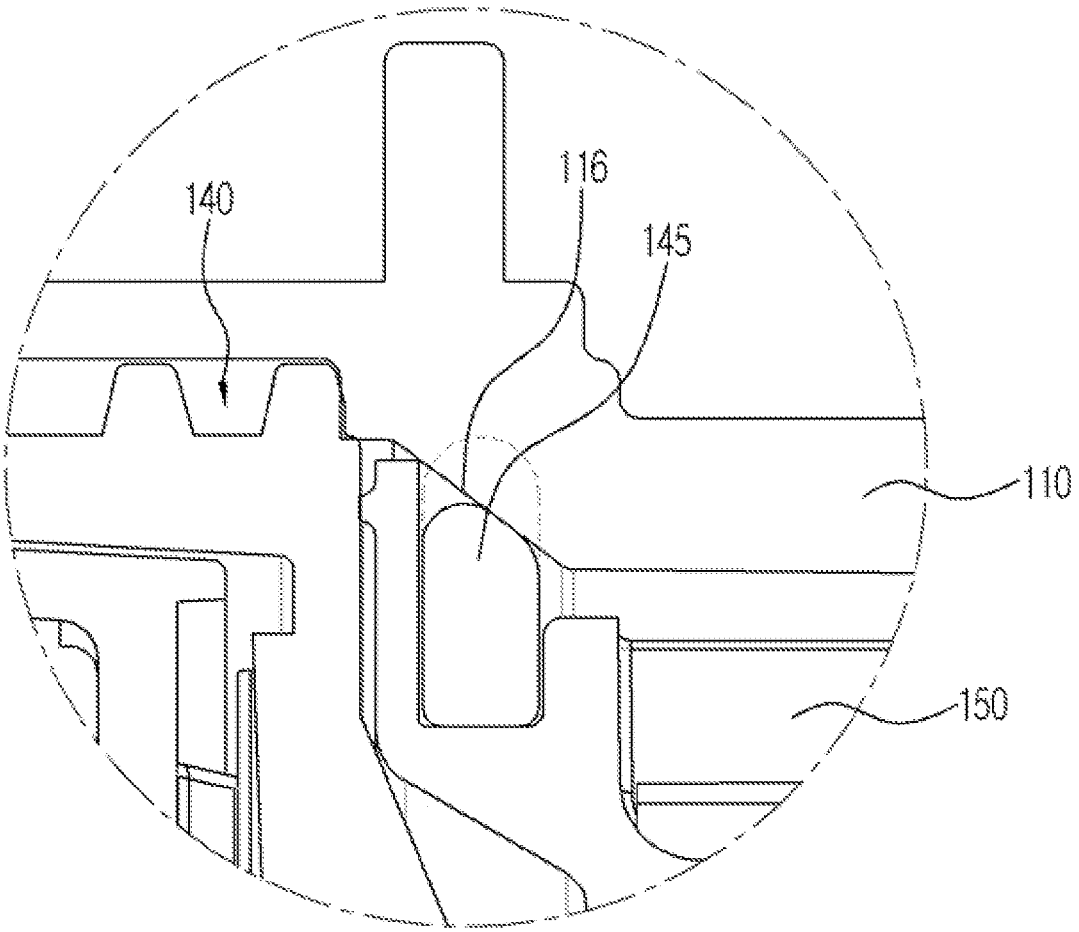
FIG. 9 is an enlarged view illustrating a portion B of FIG. 8.

FIG. 9 is an enlarged view illustrating a portion B of FIG. 8.

As illustrated in FIG. 9, the pump filter 160 may include a pump case inclination surface 116 in which at least a part of the pump case 110 contacting the pump filter 160 is inclined. This is to reduce force required when the user detaches the pump filter 160 from the pump case 110.

The sealing member 145 may be positioned between the pump filter body 150 and the pump case 110 so as to prevent water leak and to absorb a shock or noise. The sealing member 145 may be formed of a flexible material. Thus, the sealing member 145 is as shown by a dotted line before the pump filter 160 is inserted into the pump case 110, and after the pump filter 160 is inserted into the pump case 110, the shape of the sealing member 145 may be changed, as shown by a solid line.

Figure 10:
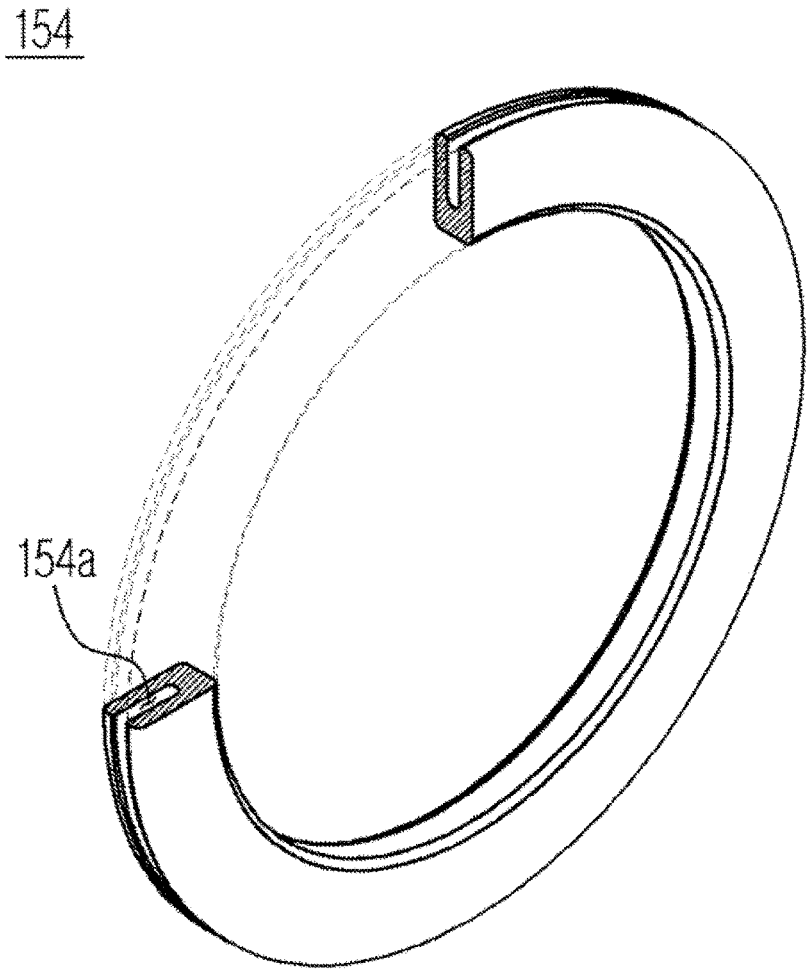
FIG. 10 is a view illustrating a sealing member according to one embodiment.
Figure 11:
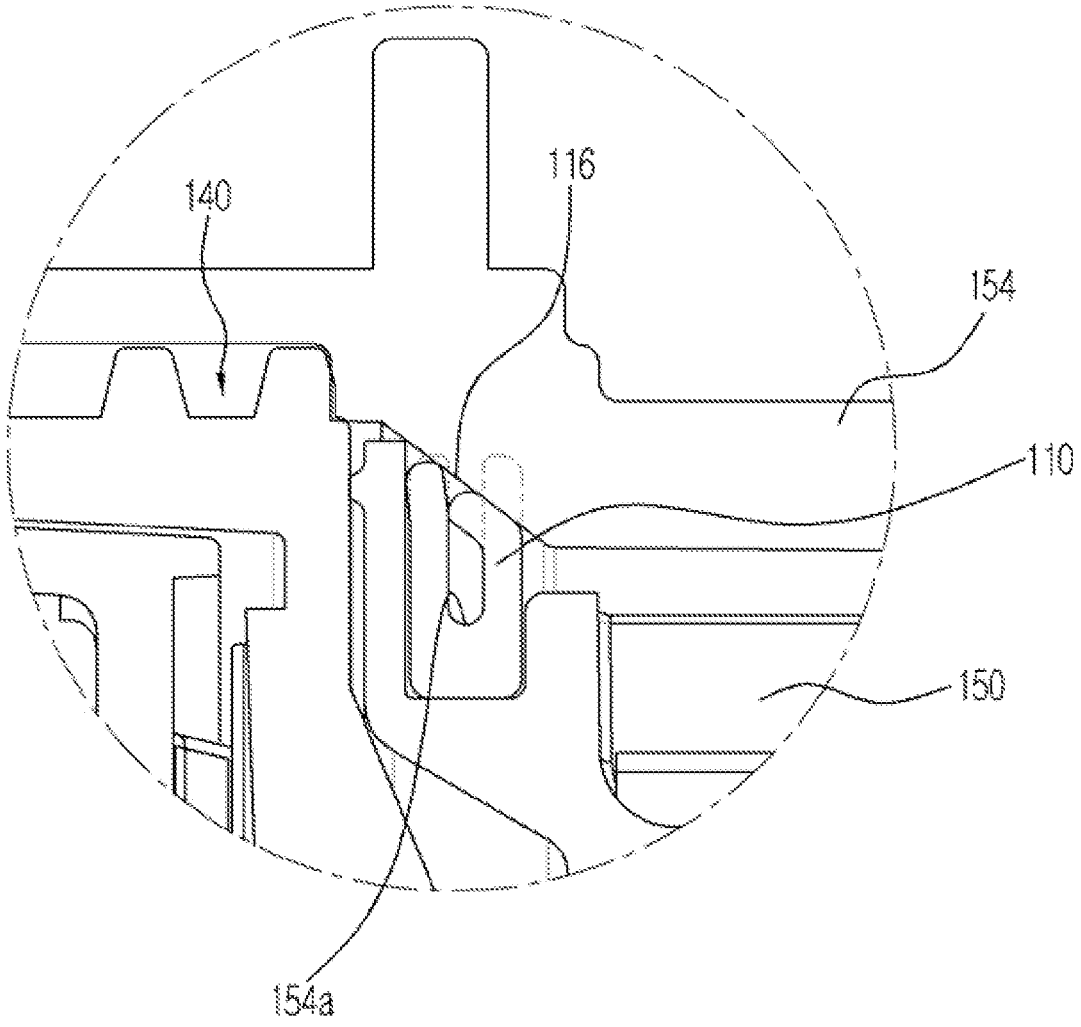
FIG. 11 is an enlarged view illustrating a part of the drain pump with which the sealing member illustrated in FIG. 10 is combined.

FIG. 10 is a view illustrating a sealing member according to one embodiment, and FIG. 11 is an enlarged view illustrating a part of the drain pump with which the sealing member illustrated in FIG. 10 is combined.

As illustrated in FIGS. 10 and 11, a sealing member 154 may include a concave part 154*a* in which at least a part of a thickness surface of the sealing member 154 is concave. This is to reduce force required when the user detaches the pump filter 160 from the pump case 110.

The sealing member 154 before the pump filter 160 is inserted into the pump case 110, is as shown by a dotted line. However, the sealing member 154 after the pump filter 160 is inserted into the pump case 110, may be bent in a space formed by the concave part 154*a*, as shown by a solid line.

Since a predetermined space between the sealing member 154 and the pump case 110 is formed due to the concave part 154*a*, the user can easily detach the pump filter 160 from the pump case 110.

According to an embodiment, the user can emotionally recognize whether the pump filter is fully fastened to the pump case. Thus, damage caused by water leak that occurs when the pump filter is not fully fastened to the pump case can be prevented.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a tub disposed in the cabinet to accommodate washing water in the tub;

a pump case including a washing water inflow chamber and a drain pump chamber to drain the washing water in the tub;

a pump filter that filters foreign substances in the washing water drained from the tub by the pump case and that is detachable from the pump case; and a pump filter head including a first head combinable with the pump filter at a first side of the first head, rotatable in one of a clockwise direction and a counterclockwise direction so that the first head is in a first state in which the first head is engaged with and combined with the pump case at the first side of the first head with the pump filter being inserted into the pump case, and rotatable in the other of the clockwise direction and the counterclockwise direction so that the first head is in a second state in which the first head is released from the pump case with the pump filter being detachable from the pump case, and a second head that is positioned at a second side of first head opposite the first side of the first head and is rotatable separately from the first head in at least one of the clockwise direction and the counterclockwise direction while the first head is in the first state, thereby generating an auditory or tactile change.

2. The washing machine according to claim 1, wherein the first head includes at least one first head protrusion part provided at the second side of the first head so as to protrude toward the second head, and the second head includes at least one second head protrusion part provided at an inner side of the second head so as to protrude toward the first head, wherein the at least one first head protrusion part and the at least one second head protrusion part are disposed to contact and pass each other when the second head is rotated in the at least one of the clockwise direction and the counterclockwise direction while the first head is in the first state.

3. The washing machine according to claim 2, wherein at least three second head protrusion parts are provided.

4. The washing machine according to claim 2, wherein the first head has a plurality of first head protrusion parts, and a distance between the plurality of first head protrusion parts is uniform.

5. The washing machine according to claim 2, wherein at least one of the at least one first head protrusion part and the at least one second head protrusion part includes an inclination part having one inclined surface.

6. The washing machine according to claim 2, wherein the second head further includes a slit provided close to the at least one second head protrusion part so that the at least one second head protrusion part has flexibility with respect to the second head.

7. The washing machine according to claim 1, wherein the first head and the second head are combined with each other so as to be spaced apart from each other by a predetermined distance.

8. The washing machine according to claim 7, further comprising an elastic member that is positioned between the first head and the second head so as to prevent a noise and shock caused by contact between the first head and the second head.

9. The washing machine according to claim 1, wherein the first head includes a hanging jaw at at least a part of the first head so as to prevent the first head from being rotated with respect to the pump case while the first head is in the first state.

10. The washing machine according to claim 1, wherein the second head includes a graspable handle part combined with an outer side of the second head.

11. The washing machine according to claim 1, further comprising a sealing member that is combined with the first side of the first head so as to absorb friction between the pump filter and the pump case and to prevent water leak.

12. The washing machine according to claim 11, wherein the pump case further includes a pump case inclination surface having an inclined surface at a part of the pump case contacting the pump filter near the pump filter head.

13. The washing machine according to claim 11, wherein the sealing member includes a concave part in which at least a part of a thickness surface of the sealing member is concave, so as to reduce force required when the pump filter is detached from the pump case.

14. A washing machine comprising:
- a cabinet;
- a tub; and
- a drain pump that pumps washing water in the tub,
- wherein the drain pump comprises:
  - a pump case including a washing water inflow chamber and a drain pump chamber; and
  - a pump filter that filters foreign substances in the washing water flowing from the tub into the pump case and is detachable from the pump case,
  - wherein the pump filter comprises:
    - a pump filter body insertable into the pump case; and
    - a pump filter head including
      - a first head combinable with a front of the pump filter body at a first side of the first head, combinable with the pump case at the first side of the first head, and rotatable in one of a clockwise direction and a counterclockwise direction, and
      - a second head positioned at a second side of the first head opposite the first side of the first head and rotatable separately from the first head in at least one of the clockwise direction and the counterclockwise direction while the first head is in a state in which the first head is combined with the pump case, thereby generating a sound indicating the pump filter body is normally combined with the pump case.

15. The washing machine according to claim 14, wherein a sound is generated in the pump filter head due to separate rotation of the second head.

16. The washing machine according to claim 14, wherein
- the first head includes at least one first head protrusion part provided at the second side of the first head so as to protrude toward the second head, and
- the second head includes at least one second head protrusion part provided at an inner side of the second head so as to protrude toward the first head,
- wherein, when the second head is rotated with respect to the first head in the state in which the first head is combined with the pump case, an auditory or tactile change is generated in the pump filter head.

17. The washing machine according to claim 14, further comprising an elastic member that is positioned between the first head and the second head so that a predetermined distance between the first head and the second head is able to be maintained when the first head is combined with the pump case.

18. The washing machine according to claim 14, wherein
- the first head includes at least one hanging jaw at at least a part of the first head, and
- the pump case includes a contact part at at least a part of the pump case so as to contact the hanging jaw,
- whereby the pump filter head is combined with the pump case.

19. The washing machine according to claim 14, further comprising a sealing member that is combined between the pump filter head and the pump case so as to absorb friction between the pump filter and the pump case and to prevent water leak.

20. A drain pump comprising:
- a pump case in which washing water is accommodated; and
- a pump filter that filters foreign substances in the washing water in the pump case and includes a body and a pump filter head that are detachable from the pump case,
- wherein the pump filter head comprises:
  - a first head combinable with the pump case at a first side of the first head and rotatable in one of a clockwise direction and a counterclockwise direction; and
  - a second head that is combined with a second side of the first head opposite the first side of the first head and is additionally rotatable from the first head in at least one of the clockwise direction and the counterclockwise direction after the first head is combined with the pump case,
  - wherein an auditory or tactile change is generated in the pump filter head due to separate rotation of the second head with respect to the first head.

21. The drain pump according to claim 20, wherein the first head includes a hanging jaw through which the pump filter head is combined with the pump case, and
- the pump case includes a contact part through which the pump case is combined with the first head.

22. The drain pump according to claim 21, further comprising an elastic member that is positioned between the first head and the second head so as to maintain a balance between the first head and the second head.

23. The drain pump according to claim 20, wherein the first head further includes at least one first head protrusion part provided at the second side of the first head so as to protrude toward the second head, and the second head includes at least one second head protrusion part provided at an inner side of the second head so as to protrude toward the first head, wherein the at least one first head protrusion part and the at least one second head protrusion part are disposed to contact and pass each other when the second head is rotated in the at least one of a clockwise direction and a counterclockwise direction while the first head is combined with the pump case.

* * * * *